US005186039A

United States Patent [19]

Celette

[11] Patent Number: 5,186,039

[45] Date of Patent: Feb. 16, 1993

[54] DEVICE FOR MOUNTING A CLAMP FOR HOLDING THE BOTTOM OF A VEHICLE BODY ON A REPAIR STAND INTENDED FOR REPAIRING THE COACHWORK OF THIS VEHICLE

[76] Inventor: Germain Celette, 1 rue Porterne, 38299 Vienne, France

[21] Appl. No.: 756,151

[22] Filed: Sep. 6, 1991

[30] Foreign Application Priority Data

Sep. 10, 1990 [FR] France ..... 90 11356

[51] Int. Cl.[5] ..... B21D 1/12

[52] U.S. Cl. ..... 72/457; 72/705

[58] Field of Search ..... 72/705, 457

[56] References Cited

U.S. PATENT DOCUMENTS 4,538,444 9/1985 Yamada ..... 72/705
4,916,933 4/1990 Celette ..... 72/705

FOREIGN PATENT DOCUMENTS 0072725 7/1982 European Pat. Off. .
0215512 8/1986 European Pat. Off. .
2745807 10/1977 Fed. Rep. of Germany .
2591328 12/1985 France .
2621261 10/1987 France .
2637205 10/1988 France .
2175239 5/1985 United Kingdom .

*Primary Examiner*—Lowell A. Larson
*Attorney, Agent, or Firm*—Wall and Roehrig

[57] ABSTRACT

Device in which each clamp is mounted at the top end of a support consisting of a vertical screw which, mounted in a horizontal slideway projecting outwards from the repair stand at right angles to the latter, is adjustable vertically and transversely relative to the repair stand by means of nuts engaged on the screw and bearing respectively against the top and bottom faces of the slideway.

According to the invention the slideway consists of two parallel bars fixed on a plate at their end situated on the repair stand and associated at their other end with removable connection means.

8 Claims, 3 Drawing Sheets

DEVICE FOR MOUNTING A CLAMP FOR HOLDING THE BOTTOM OF A VEHICLE BODY ON A REPAIR STAND INTENDED FOR REPAIRING THE COACHWORK OF THIS VEHICLE

BACKGROUND OF THE INVENTION

The subject of the present invention is a device for mounting a clamp for holding the bottom of a vehicle body on a repair stand intended for repairing the coachwork of this vehicle.

DESCRIPTION OF THE PRIOR ART

For the purpose of carrying out checking and realignment operations on the coachwork of a damaged vehicle, it is expedient to hold this vehicle perfectly immobilized relative to a repair stand.

In order to achieve such an immobilization it is known to fasten the vehicle, whose coachwork is to be repaired, by means of four clamps gripping the two battens of the bottom of the body of said vehicle. It is imperative to be able to effect the adjustment of the position of each clamp both longitudinally and transversely relative to the repair stand and in the vertical direction.

European Patent 0 072 725 in the name of the Applicant describes a device in which each clamp is mounted on a support consisting of a screw for vertical orientation mounted in a horizontal slideway projecting outwards from the repair stand at right angles to the latter. Nuts engaged on the screw and bearing against the top and bottom faces of the slideway permit adjustment of the position of the clamp both vertically and transversely relative to the repair stand. Each slideway carrying a clamp is in turn mounted for longitudinal adjustability on a longitudinal column, locking in the desired position being achieved with the aid of an eccentric.

Although this solution is fully satisfactory from the functional point of view, when a clamp has to be removed, for example in order to facilitate the placing of a vehicle in position on the repair stand, it requires the complete unscrewing of the screw forming the support for the clamp in question, thus entailing a lengthy and tedious operation. In addition, it is not easy to remove the slideways quickly, and this also constitutes a handicap.

SUMMARY OF THE INVENTION

The present invention seeks to obviate these disadvantages by providing a device for mounting a clamp, permitting instantaneous placing in position and withdrawal of the clamp, and also, in the case of a repair stand having grooves leading out into its upper face, providing a technical solution permitting immediate mounting and removal of the clamp support slideways.

To this end, in the device of the aforesaid type to which the invention relates, the slideway consists of two parallel bars fixed on a plate at their end situated on the repair stand and associated at their other end with removable connection means.

When the clamp is in the position of use, the slideway is closed at both ends. When the clamp has to be withdrawn, it is only necessary to unscrew slightly the two nuts which lock it on the slideway and to open the slideway at its free end, in order to withdraw the clamp and its screw support by sliding at this open end.

In one form of construction of this device, the bars are provided at their free ends with two parallel vertical lugs having two slots leading out onto their end faces, while the removable connection means consist of a plate having a length corresponding to the distance between the lugs and intended to be inserted between the latter to form a brace between the bars, the outer face of which plate is equipped with means for fastening it in the slots in the two lugs on the bars.

It is interesting to note that the plate carrying the removable connection means constitutes a brace which holds in perfectly parallel positions the two bars constituting the slideway, so that said bars cannot move towards or away from one another through the action of stresses exerted by the nuts associated with the screw during repair operations on the coachwork.

The means for fastening the plate forming a brace on the two lugs on the bars advantageously consist of a bar disposed longitudinally in relation to the plate and provided at one end with a stop intended to bear against the outer face of a lug and provided at the other end with a pivoting eccentric member intended to bear against the outer face of the other lug.

In a preferred embodiment the outer face of the plate is in this case equipped with a sleeve-shaped member which is fastened to it and inside which the clamp bar is mounted for axial sliding.

The floating mounting of the locking means relative to the plate permits self-centering of said means in relation to the lugs provided on the bars constituting the slideway.

In order to adjust the clamping despite manufacturing differences, the clamp bar is provided with a stop consisting of a nut engaged on an axial threaded rod forming one end of the bar.

According to another feature of the invention, in cases where the clamp is intended to be mounted on a repair stand onto whose top face longitudinal grooves lead out, said grooves having an inverted T section, the plate definitively fixed on the two bars of the slideway is fastened to a base plate which is intended to bear against the top face of the repair stand and is provided, at the level of the groove, with two cutouts formed in its two opposite edges, each serving for the passage of a profiled member intended to be locked in the groove, a part of said member passing through a cutout in the base plate and being fastened by a wedge bearing against the top face of the base plate on each side of the cutout.

This arrangement is very interesting because it permits instantaneous mounting and removal of each clamp support slideway, as well as the longitudinal adjustment of the slideway relative to the repair stand. This is particularly interesting because it makes it possible to withdraw the slideways when a vehicle is placed in position on the repair stand or withdrawn from the latter.

The base plate is advantageously provided with two centering cubes projecting from its bottom face and having sides equal to the width of a groove in the repair stand, said cubes being intended for engagement in said groove.

These two cubes associated with the base plate effect on the one hand the centering and longitudinal guiding of the base plate on the repair stand, and on the other hand prevent the slideway from rocking when it is placed on the repair stand, before being fastened to the latter.

In order to permit maximum travel of the clamps in the transverse direction relative to the repair stand, that is to say the mounting of each clamp flush with the repair stand, the base plate is provided with a cutout situated facing the slideway and leading out onto its edge turned towards the latter.

In any case the invention will be better understood with the aid of the description given below with reference to the accompanying schematic drawings showing, by way of non-limiting example, one form of construction of this device.

DESCRIPTION OF THE PREFERRED EMBODIMENTS

Figure 1:
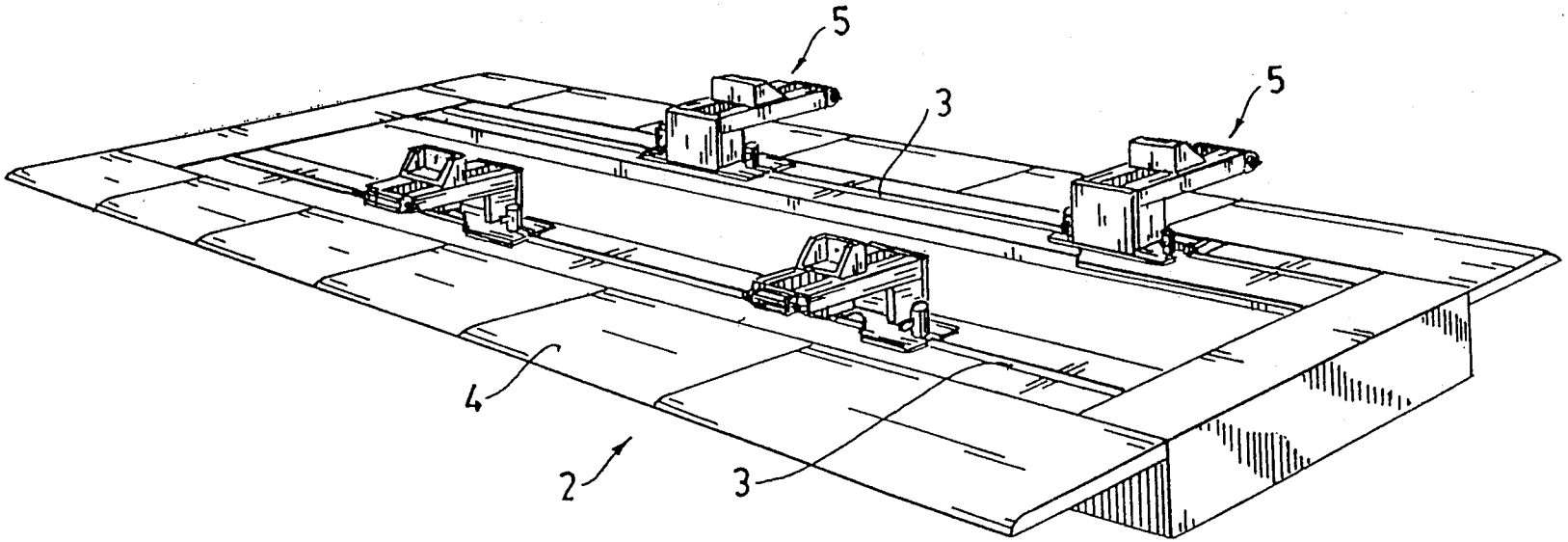
FIG. 1 is a view of a repair stand equipped with four clamps fixed on it with the aid of the device according to the invention.
Figure 2:
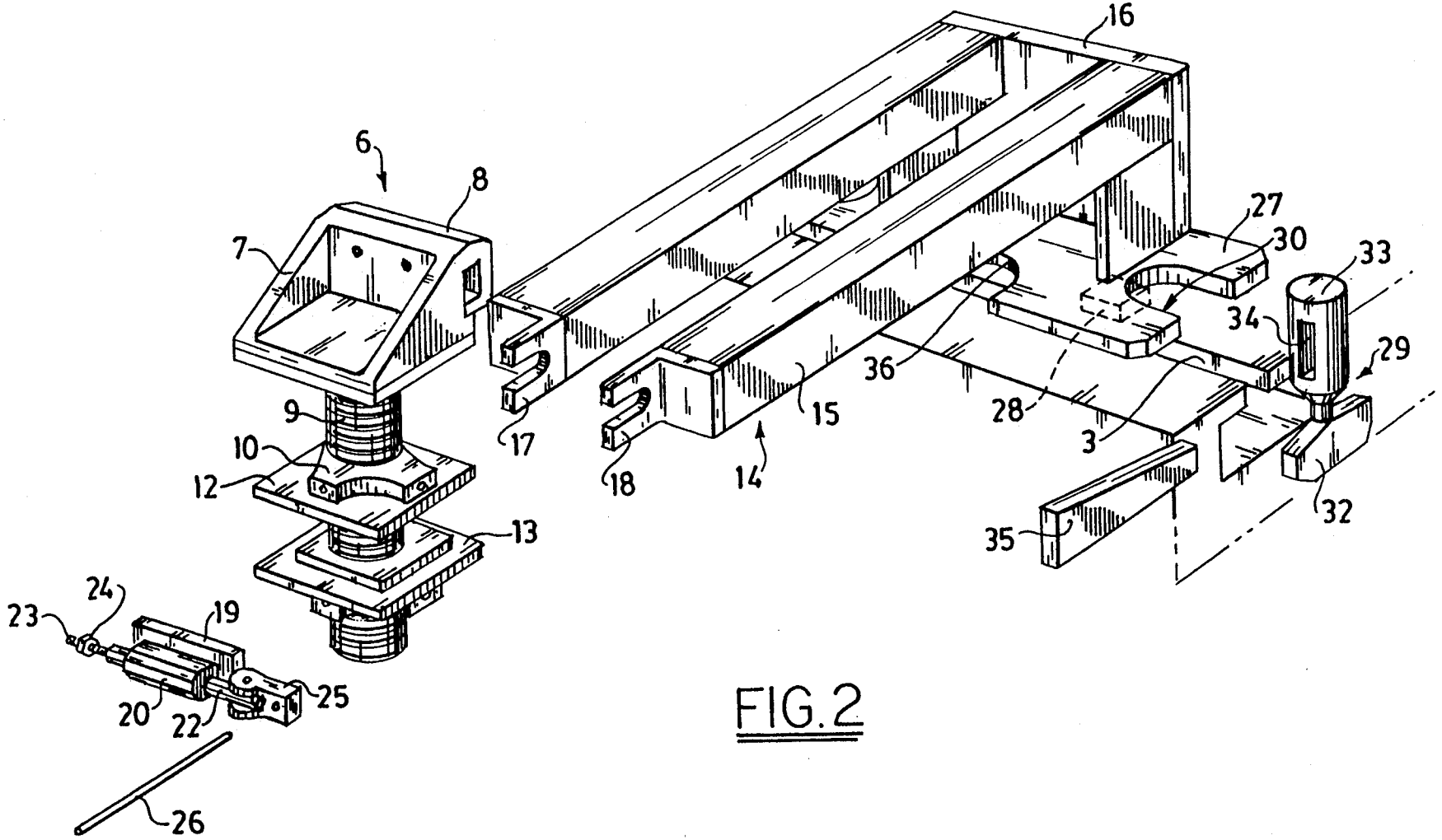
FIG. 2 is an exploded view in perspective of the principal component parts of this device.
Figure 3:
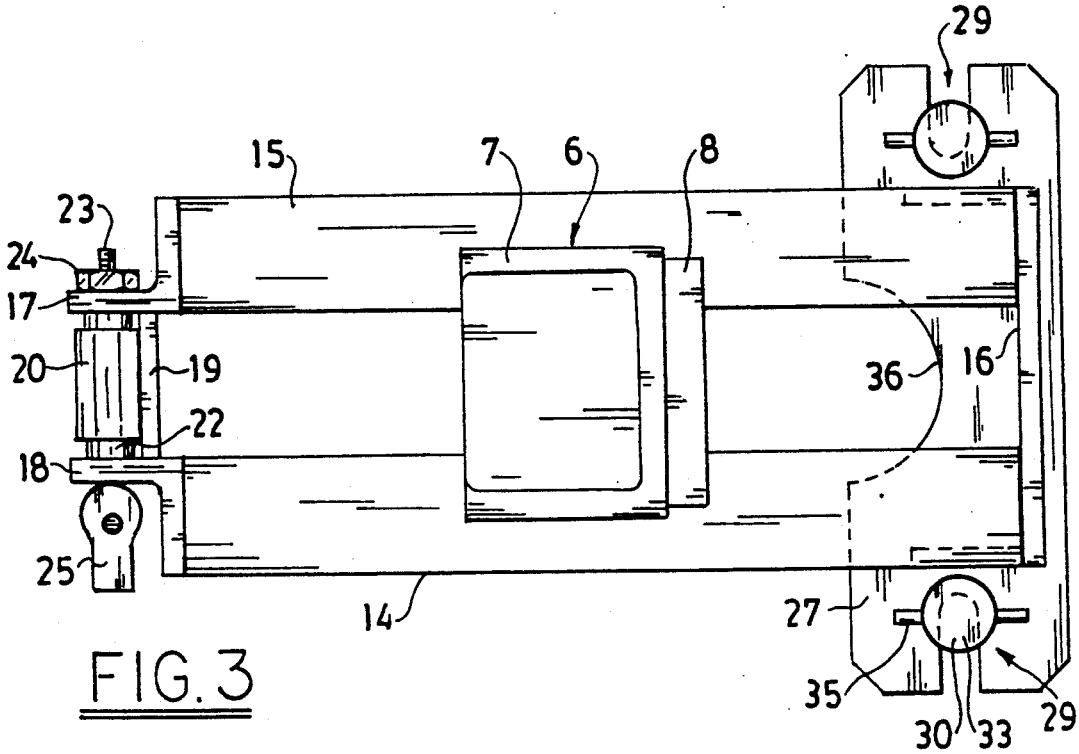
FIG. 3 is a very schematic plan view of this device in the position for fastening a vehicle on the repair stand.
Figure 4:
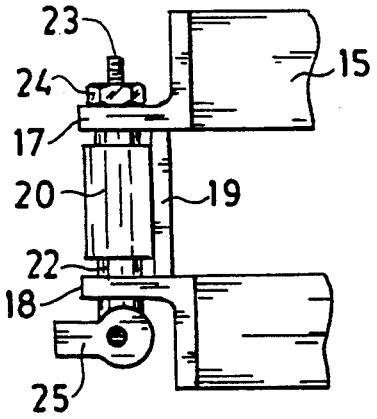
FIG. 4 is a partial view of FIG. 3 in the course of the operation of opening the slideway.

FIG. 1 shows a repair stand given the general reference 2 and composed of metal sections joined together to form a frame of rectangular general shape. The top face of this repair stand is machined and its two longitudinal uprights have grooves of inverted T shape, each leading onto its top face, said grooves being given the reference 3. This repair stand is equipped with platforms 4 enabling the vehicle to be placed in position and withdrawn, it being made clear that these platforms 4 are removable and can be withdrawn during checking and repair operations.

This repair stand is equipped with four clamp devices 5 intended to be fixed on the vehicle on the battens of the bottom of the body of the latter.

Each device comprises a clamp 6 having a fixed jaw 7 and a movable jaw 8, the fixed jaw 7 being mounted at the top end of a vertical screw 9, with which are associated two nuts 10, two chocks 12, and two centering members 13. The two nuts 10 and the members associated with them are intended to come to bear respectively against the top face and against the bottom face of a slideway 14. This slideway 14 is composed of two bars 15 of rectangular section, fixed by one end on a vertical plate 16. At their other end the bars 15 are provided with two vertical lugs 17 forming extensions of the opposite faces of the bars 15 and each having a slot 18 leading out onto its end face. The lugs 17 and slots 18 are intended to effect the mounting of removable connection means between the two bars 15. These removable connection means consist of a plate 19 whose length corresponds to the distance between the two lugs 17, and which is intended to be inserted between the latter to form a brace. On the outer face of the plate 20 is mounted a sleeve 20 of polygonal section, directed in the lengthwise direction of the plate. In this polygonal sleeve is slidingly mounted a bar 22, likewise polygonal, of which one end terminates in an axially directed threaded rod 23, on which is engaged a nut 24. The other end of the bar 22 is equipped with an eccentric-shaped member 25, which is capable of being operated rotationally by a rod 26. The nut 24 and the eccentric 25 are intended to come to bear against the outer faces of the two lugs. The adjustment of the nut 24 makes it possible to allow for manufacturing tolerances. In practice, in order to close the slideway 14, the plate 19 should be engaged between the two lugs 17, the position of the nut 24 should be adjusted if required, and the eccentric 25 then moved into its locking position.

As shown in the drawing, the plate 16 is fixed on a base plate 27, which is at right angles to it and which is intended to come to bear against the top face of the repair stand. To this end the base plate 27 has two cubes 28 which project from its bottom face and whose side is equal to the width of a groove 3 in the repair stand, these two cubes 28 effecting longitudinal positioning of the base plate 27 relative to the repair stand and preventing the rocking of the assembly consisting of the base plate and the slideway 14 before the base plate has been fixed on the repair stand. Fastening on the repair stand is effected by means of two mortise connectors given the general reference 29. For this purpose the base plate 27 has two cutouts 30 leading onto its two opposite transverse edges. Each mortise connector 29 has a profiled foot 32 intended to be engaged in a groove 3 when it is directed longitudinally in relation to the latter, before being pivoted 90° by action on its stem 33 which projects upward and which passes through the cutout 30. The stem 33 has a through passage 34 for a wedge-shaped key 35. After the profiled foot 32 of the connector has been directed at right angles to the groove, the key 35 is inserted into the passage 34 and comes to bear against the top face of the base plate 27, which it locks on the repair stand.

On its edge turned towards the slideway the base plate 27 likewise has a cutout 36 facing said slideway. This cutout 36 enables the clamp screw to be positioned as close as possible to the repair stand, since the screw 9 of the clamp 6 can come into the immediate vicinity of a longitudinal member of the repair stand without being obstructed by the base plate 27.

As can be seen from the foregoing, the invention provides a great improvement to the existing technique by supplying a device for mounting a clamp on a repair stand which is of simple design and permits immediate placing in position and withdrawal of the clamp in relation to the corresponding slideway, as well as very rapid mounting and removal of the slideway in relation to the repair stand, if the latter is equipped with grooves leading out onto its upper face.

As is obvious, the invention is not limited to the sole form of construction of this device described above by way of example, but on the contrary it embraces all variant embodiments. Thus, in particular, the closing means of the slideway could be different and could consist of screw members, a stop being mounted in a fixed position on a threaded rod, while the other stop consists of a nut engaged on this rod, without thereby departing from the scope of the invention.

What is claimed is:

1. A device for mounting a clamp for holding a base of a vehicle body on a repair stand frame intended for repairing of coachwork of the vehicle, in which said clamp includes a vertical support member consisting of a vertical threaded screw mounting said clamp at an upper end thereof; said device including a vertical support attached to said frame, a horizontal slideway extending transversely with respect to said frame and affixed onto said vertical support and formed of a pair of parallel horizontal bars with proximal ends thereof affixed onto the vertical support and distal free ends; upper and lower threaded nuts engaged on said screw and bearing against upper and lower surfaces of said pair of parallel bars to permit the clamp to be adjusted transversely along said slideway and to be adjusted vertically by their position on said screw; and removable connection means releasably joining and bracing the free ends of said bars to maintain a parallel relation between the pair of bars under stresses exerted by coachwork repair on the vehicle, without interfering with the transverse removal or installation of said clamp over the distal end of said slideway.

2. The device as claimed in claim 1, wherein the . bars are provided at their free ends with two parallel vertical lugs having two slots leading out onto distal end faces thereof, while the removable connection means include a plate having a length corresponding to the distance between the lugs and intended to be inserted between the latter to form a brace between the bars, the outer face of which plate is equipped with means for fastening it in the slots in the two lugs on the bars.

3. The device as claimed in claim 2, wherein the means for fastening the plate forming a brace on the two lugs on the bars include a clamp bar disposed longitudinally in relation to the plate and provided at one end with a stop intended to bear against the outer face of one said lug and provided at the other end with a pivoting eccentric member intended to bear against the outer face of the other lug.

4. The device as claimed in claim 3, wherein an outer face of the plate is equipped with a sleeve-shaped member which is fastened to it and inside which the clamp bar is mounted for axial sliding.

5. The device as claimed in claim 3, wherein the clamp bar is provided with a stop including a nut engaged on an axial threaded rod forming one end of the bar.

6. The device as claimed in claim 1, wherein in cases where the clamp is intended to be mounted on a repair stand onto whose top face longitudinal grooves lead out, said grooves having an inverted T section, the vertical support including a vertical support plate securely affixed onto the two bars of the slideway and fastened to a base plate which is intended to bear against a top face of the repair stand and is provided, at the level of said groove, with two cutouts formed in its two opposite edges, each serving for the passage of a profiled member intended to be locked in the groove, a part of said member passing through a cutout in the base plate and being fastened by a wedge bearing against a top face of the base plate on each side of the cutout.

7. The device as claimed in claim 6, wherein the base plate is provided with two centering cubes projecting from its bottom face and having sides equal to the width of a groove in the repair stand, said cubes being intended for engagement in said groove.

8. The device as claimed in claim 6, wherein the base plate is provided with a cutout situated facing the slideway and leading out onto its edge turned towards the latter.

* * * * *